United States Patent [19]

Ginther

[11] 3,979,131

[45] Sept. 7, 1976

[54] SKI BINDING

[76] Inventor: George E. Ginther, 432 Porter Ave., Buffalo, N.Y. 14201

[22] Filed: Mar. 18, 1975

[21] Appl. No.: 559,540

[52] U.S. Cl. ..... 280/615; 280/636

[51] Int. Cl.[2] ..... A63C 9/10

[58] Field of Search ..... 280/11.35 B, 11.35 C, 280/11.35 Y, 11.35 W, 11.35 L

[56] References Cited

UNITED STATES PATENTS

| | | | |
|---|---|---|---|
| 2,450,514 | 10/1948 | Humlegard | 280/11.35 B |
| 2,643,888 | 6/1953 | Hargis, Jr. | 280/11.35 W |
| 3,823,953 | 7/1974 | With | 280/11.35 B |
| 3,874,684 | 4/1975 | Dysthe | 280/11.35 B |

FOREIGN PATENTS OR APPLICATIONS

| | | | |
|---|---|---|---|
| 993,234 | 10/1951 | France | 280/11.35 B |
| 57,945 | 3/1936 | Norway | 280/11.35 B |
| 105,234 | 8/1942 | Sweden | 280/11.35 B |
| 234,906 | 1/1969 | U.S.S.R. | 280/11.35 B |

*Primary Examiner*—M. H. Wood, Jr.
*Assistant Examiner*—David M. Mitchell
*Attorney, Agent, or Firm*—Christel & Bean

[57] ABSTRACT

A binding for skis of the touring or cross country type comprising a toe plate element fixed to the ski and having a base and upstanding side walls for receiving the toe portion of a ski boot to restrain the boot against forward and lateral movement relative to the ski, a heel plate element fixed to the ski for grippingly engaging the heel of the boot, and a toe spring clamp element fixed to the toe plate element and having a pair of spaced apart, curved outwardly extending arms for clampingly engaging the ski boot along the sides of the toe portion.

10 Claims, 7 Drawing Figures

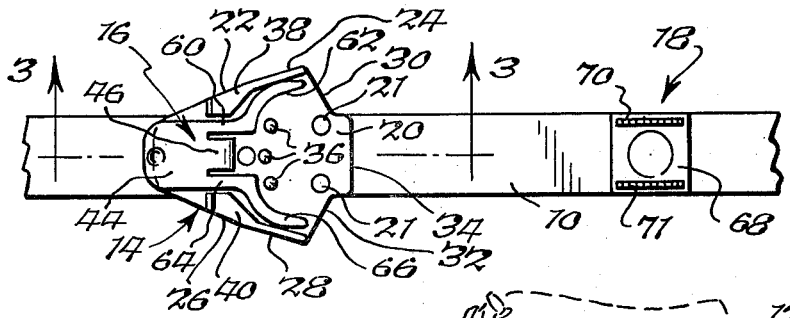
Fig. 1.
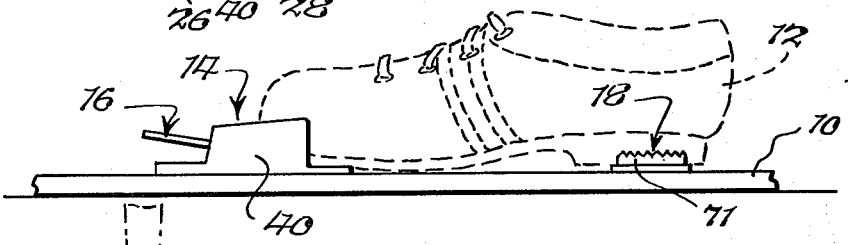
Fig. 2.
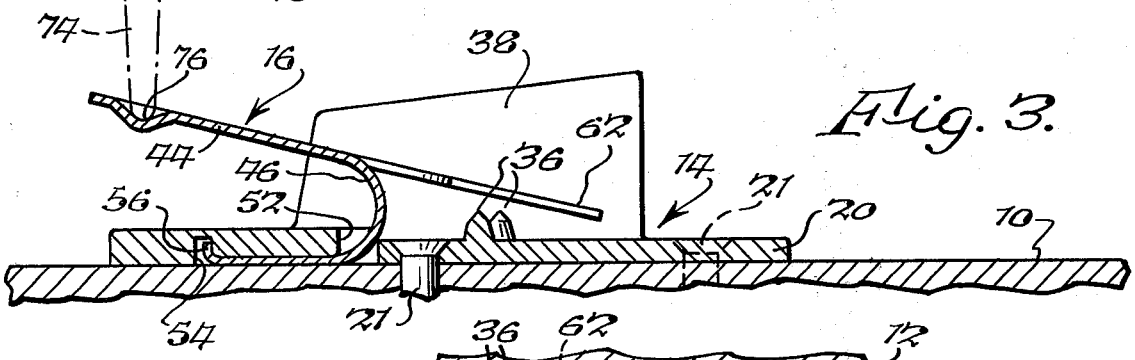
Fig. 3.
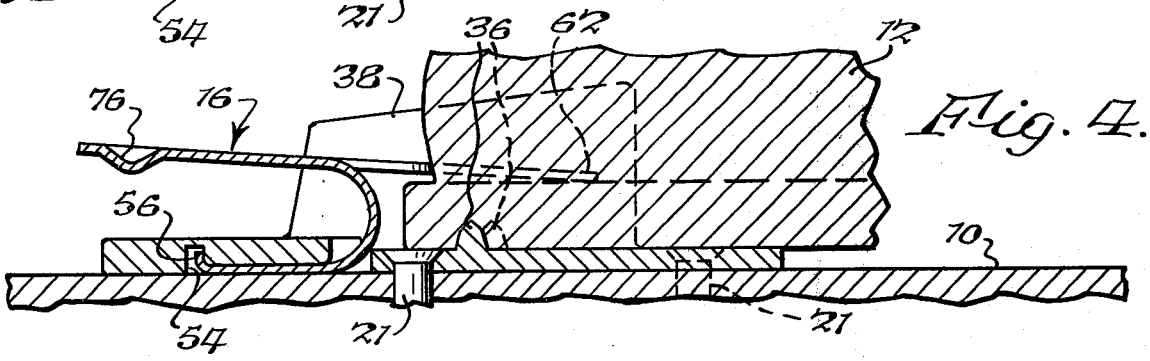
Fig. 4.
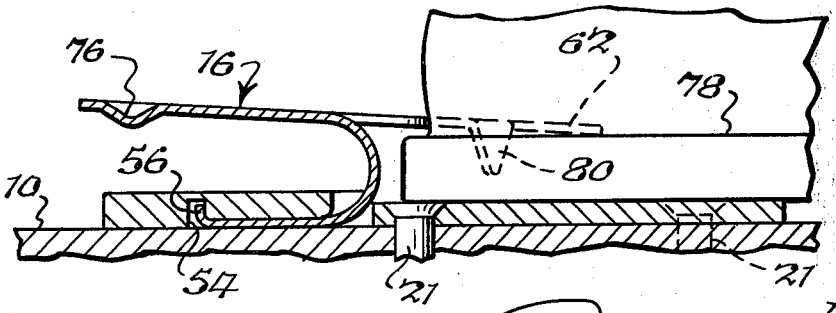
Fig. 5.
Fig. 6.
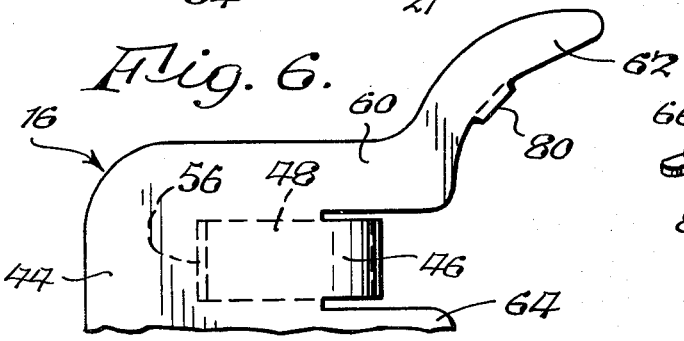
Fig. 7.
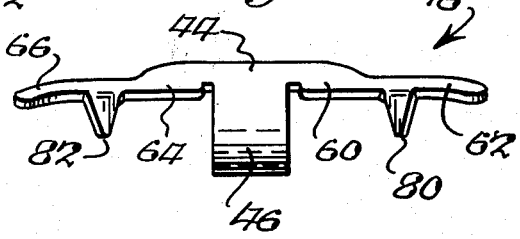

SKI BINDING

BACKGROUND OF THE INVENTION

This invention relates to the art of athletic equipment, and more particularly to a new and improved binding for touring skis.

In recent times, skiing of the touring or cross country type has experienced growing popularity. While many varieties of ski bindings have been proposed and patented for use in the downhill type of skiing, different considerations enter into the design of bindings for touring skis. In particular, such bindings should be light in weight, relatively simple in construction, and effective but not overly restrictive in holding the boot of a skier.

SUMMARY OF THE INVENTION

It is, therefore, an object of this invention to provide a new and improved binding for touring skis.

It is a more particular object of this invention to provide such a binding which effectively holds the boot of a skier but not in an overly restrictive manner.

It is a further object of this invention to provide such a ski binding which is relatively simple in construction and light in weight.

It is a further object of this invention to provide such a ski binding which is easy to use and economical to manufacture.

The present invention provides a binding for touring skis comprising a toe plate element fixed to the ski for receiving the front or toe portion of a skier's boot, a heel plate element fixed to the ski for grippingly engaging the heel portion of the boot, and a toe clamp element in the form of a bail spring element fixed to the toe plate element for engaging the boot on opposite sides of the front or toe portion in a manner holding the same. The toe clamp is of spring metal including two curved arms for engaging the boot, each arm having an accurate length no greater than about one quadrant of a circle, whereby the boot is releasably held an effective but not overly restrictive manner.

The foregoing and additional advantages and characterizing features of the present invention will become clearly apparent upon a reading of the ensuing detailed description together with the included drawings wherein:

BRIEF DESCRIPTION OF THE DRAWING FIGURES

FIG. 1 is a top plan view of a ski binding of the present fixed to a ski, the latter being shown fragmentarily;

FIG. 2 is a side elevational view of the ski and binding of FIG. 1 with a ski boot held therein and the ski in a position of use on a supporting surface;

FIG. 3 is an enlarged fragmentary sectional view taken about on line 3—3 of FIG. 1 and illustrating the binding before insertion of a ski boot;

FIG. 4 is a fragmentary sectional view similar to FIG. 3 and illustrating the binding after insertion of a ski boot;

FIG. 5 is a view similar to FIG. 4 illustrating a toe clamp element according to another embodiment of the present invention;

FIG. 6 is a fragmentary top plan view of the toe clamp element of the binding shown in FIG. 5; and FIG. 7 is an end elevational view of the toe clamp element taken from the right hand side in FIG. 6.

DETAILED DESCRIPTION OF THE ILLUSTRATED EMBODIMENTS

Referring now to FIGS. 1 and 2, a ski binding according to the present invention is fixed to a conventional ski 10 of the touring or cross country type for releasably holding the boot 12 of a skier therein. The ski binding comprises a toe plate element 14 for receiving the front or toe portion of the boot 12 which toe plate 14 is fastened to ski 10 on the upper surface thereof and at an appropriate location approximately mid-way along the length of the ski according to conventional practice. Toe plate element 14 functions to hold or fix the toe or front portion of boot 12 in a manner preventing forward and lateral movement of boot 12 relative to ski 10 in a manner which will be described in detail presently.

The ski binding of the present invention further comprises a toe clamp element 16 operatively associated with toe plate 14 for holding or fixing the toe or front portion of boot 12 against vertical movement. Toe clamp 16 is in the form of a bail spring and the construction and operation thereof will be described in detail presently. The ski binding of the present invention also comprises a heel plate element 18, also designated a heel pop-up element, for engaging the heel of boot 12 in a manner preventing longitudinal and latteral movement of the heel portion of the boot.

Toe plate element 14 is of rigid material, preferably glass-filled Nylon, and has a planar base portion 20 mounted on ski 10 at spaced locations by suitable screw on bolt-type fasteners 21. Base 20 has a peripheral configuration or shape resembling that of an arrow head or triangle including a snub nosed front end which meets two outer leading edges at curved junctions. Each leading edge is disposed at an acute angle with respect to the longitudinal axis of ski 10 and each leading edge, for example the upper edge as viewed in FIG. 1, has a front portion 22 and a rear portion 24, the rear portion being disposed at a slightly smaller acute angle to ski 10 as compared to the front portion. The other leading edge as viewed in FIG. 1 has front and rear portions 26 and 28, respectively. The terms front and rear are used in reference to the position of ski 10 and boot 12 during forward travel. The leading edges extend outwardly of or beyond the corresponding edges of ski 10 and meet corresponding trailing edges 30 and 32. Edges 30, 32 are relatively shorter than the leading edges, are disposed at a relatively large acute angle with respect to the longitudinal axis of ski 10 and meet a rear edge portion 34 of base 20 which is disposed generally perpendicular to the axis of ski 10.

Base 20 is provided with a plurality of upstanding pin or peg elements 36 for fitting into corresponding openings provided in the sole of boot 12 for the purpose of locating or positioning boot 12 in toe plate 14. In the present illustration there are three protuberances 36 arranged generally along a line perpendicular to the longitudinal axis of ski 10 and located about mid-way along the length of plate 14 approximately adjacent the junctions of the front and rear portions of the leading edges. The central pin element is located slightly ahead of the other two elements in the present illustration. By way of example, elements 36 are about ⅜ inch in height and ⅜ inch in diameter at the base, and can be integrally formed with base 20 or separately secured to the base. The dimensions of toe plate 14 and locations of pegs 36 and fasteners 21 conform to Nordic Norm requirements.

Toe plate 14 also includes a pair of upstanding vertical side walls 38, 40 for abutting the front toe portion of boot 12. Each side wall has a relatively thin rear portion, the outer surface of which is generally coincident with the corresponding rear leading edge portion 24, 28. Each side wall has a relatively thick front portion extending forwardly and terminating in a front edge located about mid-way along the corresponding front leading edge portion and disposed generally perpendicular to the longitudinal axis of ski 10. The front edge of each wall 38, 40 meets a first inner wall surface disposed generally parallel to the longitudinal axis of ski 10. Each inner wall surface, in turn, meets a corresponding second inner wall surface extending outwardly therefrom at a relatively large acute angle with respect to the longitudinal axis of ski 10, and each of these wall surfaces, in turn, meet the surface of the corresponding rear wall portion. As shown in FIGS. 2 and 3, the front edge of each sidewall 38, 40 is slightly inclined rearwardly, the top edge of each wall tapers slightly upwardly in a rearward direction and the rear edge of each wall is disposed generally vertically.

Toe clamp 16 is in the form of a bail spring and is of metal. Spring temper, half-hard, type 301 stainless steel has been found to perform well. Toe clamp 16 has a main body portion 44 which is substantially planar and generally rectangular in shape. Clamp 16 is formed to have three separate elements extending fron one end of a body portion 44 as follows. A central leg element has a curved portion 46 which extends from body portion 44 out of the plane thereof and along a curved, generally arcuate path. The central leg element also has a planar, generally elongated or rectangular portion 48 extending from curved portion 46. When toe clamp 16 is unstressed, body portion 44 and central leg portion 48 define therebetween a relatively acute angle as shown in FIG. 3, the portions 44 and 48 being joined by curved portion 46.

The elongated portion 48 of the central leg element is fixed to base 20 of toe plate 14 in the following manner. The front or forward portion of base 20 is of a thickness approximately twice the thickness of the rear portion, the two portions meeting in a vertical step edge extending laterally of ski 10 and in approximate alignment with the junctions of the inner surface portions of the front portions of sidewalls 38, 40. A lateral slot 52 is provided in base 20 adjacent the aforementioned step, one edge of the slot being coplanar with the step and the opposite edge of the slot being in the thicker base portion. Slot 52 is of sufficient length to accommodate the central leg element of toe clamp 16, and the elongated portion 48 of the central leg is received in a recess or trough formed in the under surface of base 20, the trough extending from slot 52 in a forward direction and being of a thickness or height to receive portion 48 of the central leg in a firm, tightly held manner between the trough and the surface of ski 10 when base 20 is fastened to ski 10. The trough meets a lateral recess 54 provided in the bottom surface of base 20 near the front end thereof which recess 54 receives an upturned lip 56 formed on the end of leg portion 48 to enhance the firm securement of leg portion 48 to base 20.

Clamp 16 also has two outer arm elements extending from the same end of body portion 44 for engaging boot 12 in a manner to hold the toe or front portion of the boot in toe plate 14. These two arms both are disposed in the same plane as body portion 44. Each arm has an elongated, linear portion extending from main body portion 44 in a direction generally parallel to the longitudinal axis of ski 10 and a curved, generally arcuate portion extending outwardly therefrom in the direction of the corresponding side wall 38, 40 of toe plate 14. In particular, and referring to FIG. 1, the upper arm as viewed in FIG. 1 has a linear portion 60 extending from main body portion 44 beyond the central leg whereupon it meets a curved portion 62. The latter extends outwardly toward and is spaced slightly inwardly of sidewall 38 and terminates at an end which is in general alignment with the rear edge of sidewall 38. Similarly, the lower arm as viewed in FIG. 1 has a linear portion 64 extending from main body portion 44 beyond the central leg whereupon it meets a curved portion 66, the latter extending outwardly toward and spaced slightly inwardly of sidewall 40 and terminating at an end which is in general alignment with the rear edge of sidewall 40. Each of the curved arm portions 62, 66 has an accurate length or extent of curvature which is no greater than that of one quadrant of a circle. In other words, a radius of curvature for each curved arm portion 62, 66 would rotate or travel through an angle of no greater than 90° in describing the corresponding curved arm portion. The curved arm portions 62, 66 of toe clamp 16 in effect have a wishbone type configuration.

By way of illustration a line coincident with the inner edge surface of a curved arm portion near the outer and thereof defines an angle of about 50° with respect to the longitudinal axis of the ski. Thus the included angle between the inner edges of curved arms 62, 66 in the region of the outer ends is about 100°. Each inner edge surface of arms 62, 66 lies partially along the arc of a circle having a center at the intersection of perpendicular lines coincident with the inner edge of the corresponding arm portion 60, 64 and with the outer end or tip of arm 62, 66, the circle having a radius of about 0.75 inch.

Heel plate element 18 includes a base 68 which is fixedly mounted to the upper surface of ski 10 in a suitable manner. Base 68 is located rearwardly of toe plate 14 a distane such that base 68 is beneath the heel of boot 12 when the latter is in place. A pair of upstanding longitudinally disposed plate elements 70, 71 are provided on base 68 in spaced apart, parallel relation which elements 70, 71 preferably are of aluminum and are provided with teeth along the upper edges thereof. The heel surface of boot 12 is of a material which is sufficiently soft so that the teeth of elements 70, 71 can grippingly engage the heel under surface in a manner restraining lateral movement thereof.

The ski binding of the present invention is used in the following manner. Each ski of the pair such as ski 10, is provided with a ski binding of the present invention including toe plate 14, toe clamp 16 and heel plate 18. The ski is placed in a normal position on a supporting surface as shown in FIG. 2 and as the ski is steadied or held, the skier places the end of his ski pole 74 in a dimple or recess 76 provided in body portion 44 as shown in FIG. 3. Force is applied downwardly by the skier against the face of bail spring 16 so that body portion 44 is moved downwardly and the arms including curved portions 62, 66 are raised. The skier inserts his boot 12 with the toe portion abutting the inner surfaces of sidewalls 38, 40 of toe plate 14 and with the heel of the boot over and on heel plate 18. Then the skier releases the force applied through pole 74 whereupon curved arms 62, 64 of toe clamp 16 move downwardly and engage on contact the upper peripheral surface 78 of sole of boot 12 as shown in FIG. 4. The spring force of toe clamp 16 acts on surface 78 to clampingly engage the same thereby preventing vertical movement of this portion of boot 12 and holding the boot in place in the binding. The foregoing procedure is of course repeated for the companion boot and ski.

Providing curved arm portions 62, 66 each having a curvilinear form extending outwardly and along relative to the longitudinal axis of ski and not extending or returning inwardly toward the longitudinal axis serves to hold the boot and foot of a skier in the binding effectively but not in an unsafe overly restrictive manner. Arm portions 62, 66 extend along opposite sides of the toe or front portion of the boot but do not project or extend inwardly further long the side portions of the boot. Thus the binding of the present invention holds the boot and foot of a skier in a positive yet safe manner. The materials, size and construction of toe plate 14, toe clamp 16 and heel plate 18 provide a binding which is relatively simple yet rugged in construction and light in weight. The binding of the present invention for touring skis also is easy and convenient to install and use and is relatively economical to manufacture.

Referring now to FIGS. 5–7, the holding or clamping action of toe clamp 16 on boot 12 can be augmented by providing a locking or gripping element depending from each curved arm portion 62, 66 which locking element is received in an opening provided in surface 78 of the boot sole. One form of locking or gripping element comprises triangular shaped elements 80 and 82 which depend vertically from the inner edges of curved arms 62 and 66, respectively, and are in approximate lateral alignment with the upstanding pin elements 36. Elements 80, 82 can be formed conveniently by stamping or cutting during the same operation forming curved arms 62, 66 and then elements 80, 82 simply are bent out of the plane of arms 62, 66 each through about an angle of 90° to the position shown in FIGS. 5–7. Alternatively, the depending elements can be in the form of pins or pegs secured to arms 62, 66 such as by providing a hole in each arm and securing the upper end of the element therein.

It is therefore apparent that the present invention accomplishes its intended objects. While several embodiments of the invention have been described in detail, this is for the purpose of illustration, not limitation.

I claim:

1. A binding for touring skis comprising:

a. a toe plate element adapted to be fixed to a touring ski for receiving the toe portion of the boot of a skier, said toe plate comprising a base and a pair of upstanding side walls each having generally planar and vertical inner surface portions; and b. a toe spring clamp element operatively associated with said toe plate element and having a pair of spaced apart arms for clampingly engaging the skier's boot along the sides of the toe portion thereof, said arms being entirely inwardly of said inner surface portions of said walls and being movable freely with respect to said walls, said clamp element comprising a unitary bail spring element having a planar main body portion, means on said body portion permitting operative engagement by an end of a ski pole to operate said clamp, a central leg portion extending from one end of said main body portion and out of the plane of said body portion, said leg portion being fixed to said toe plate element, and said arms of said clamp element extending from said one end of said body portion on opposite sides relative to said central leg portion, said arms being disposed in the plane of said body portion.

2. Apparatus according to claim 1, wherein said arms of said clamp element are curved and extend outwardly relative to the longitudinal axis of the ski.

3. Apparatus according to claim 1, wherein said arms of said clamp element are curved, each arm having an arcuate length less than about one quadrant of a circle.

4. Apparatus according to claim 1, wherein said clamp element is of spring temper, half-hard, type 301 stainless steel.

5. Apparatus according to claim 1 further including a gripping element provided on each of said arms of said clamp elements, said gripping elements depending from said arms in a manner to be received in corresponding openings provided in the upper peripheral surface of the sole of the ski boot.

6. Apparatus according to claim 1, wherein toe plate upstanding side walls are each disposed at an angle relative to the longitudinal axis of the ski to prevent relative forward and lateral movement of the toe portion of the ski boot.

7. Apparatus according to claim 1, further including a plurality of upstanding pin elements on said toe plate for engaging corresponding openings in the sole of the ski boot to facilitate positioning the boot relative to said toe plate.

8. Apparatus according to claim 1, wherein said heel plate element is provided with teeth for gripping engaging the under surface of the heel of the ski boot.

9. Apparatus according to claim 1 further including a heel plate element adapted to be fixed to the ski spaced from said toe plate element for engaging the heel of the skier's boot.

10. A binding for touring skis comprising:

a. a toe plate element adapted to be fixed to a touring ski for receiving the toe portion of the boot of a skier, said toe plate comprising a base and a pair of upstanding side walls each having generally planar and vertical inner surface portions; and b. a toe spring clamp element operatively associated with said toe plate element and having a pair of spaced apart arms for clampingly engaging the skier's boot along the sides of the toe portion thereof, said arms being entirely inwardly of said inner surface portions of said walls and being movable freely with respect to said walls, said toe clamp element being unitary and of spring metal and comprising a planar main body portion, means on said body portion permitting operative engagement by an end of a ski pole to operate said clamp, a central leg portion extending from one end of said main body portion and out of the plane of said body portion, said leg portion being fixed to said toe plate element, said arms of said clamp element extending from said one end of said body portion on opposite sides relative to said central leg portion, said arms being disposed in the plane of said body portion, and said arms being curved and extending outwardly relative to the longitudinal axis of the ski.

* * * * *